United States Patent [19]

van der Werff

[11] 4,104,979

[45] Aug. 8, 1978

[54] HOPPER BARGE HAVING A BOTTOM DISCHARGE OPENING CLOSED BY HOPPER DOORS

[75] Inventor: Bartele van der Werff, Medemblik, Netherlands

[73] Assignee: A. Vuyk & Zonen's Scheepswerven B.V., Capelle aan den Ijssel, Netherlands

[21] Appl. No.: 736,932

[22] Filed: Oct. 29, 1976

[30] Foreign Application Priority Data

Nov. 4, 1975 [NL] Netherlands ..... 7512915

[51] Int. Cl.² ..... B67D 3/00

[52] U.S. Cl. ..... 114/36; 105/240; 214/15 R; 222/504; 298/31

[58] Field of Search ..... 214/12, 15 R, 15 B; 298/29–37; 105/240; 114/27, 36, 37; 222/504

[56] References Cited

U.S. PATENT DOCUMENTS

| | | | |
|---|---|---|---|
| 357,857 | 2/1887 | Rogers | 114/36 |
| 1,187,250 | 6/1916 | Brown et al. | 214/15 B X |
| 1,255,383 | 2/1918 | Burris | 298/34 |
| 3,223,113 | 12/1965 | Hopper | 222/504 X |
| 3,578,222 | 5/1971 | Pot | 114/36 X |

*Primary Examiner*—Frank E. Werner

*Attorney, Agent, or Firm*—Haseltine, Lake & Waters

[57] ABSTRACT

A hopper barge comprising a hopper having at least one center keelson box and at least one bottom discharge opening closable by at least one swivelling hopper door, as well as a control mechanism for swivelling the hopper door, wherein the control mechanism can also impose a translatory movement on the hopper door between a lower end position and a higher position, in which the hopper door is at least substantially positioned within the center keelson box.

7 Claims, 5 Drawing Figures

HOPPER BARGE HAVING A BOTTOM DISCHARGE OPENING CLOSED BY HOPPER DOORS

FIELD OF THE INVENTION

The present invention relates to a hopper barge having a hopper including at least one centre keelson box and at least one bottom discharge opening closable by at least one swivelling hopper door, as well as a control mechanism for swivelling the hopper door.

PRIOR ART

Such a known hopper barge comprises pairwise opposed hopper doors, which during opening to discharge the hopper swivel to one another about swivel axles mounted on the lower edge of the centre keelson box, the maximally open position being reached upon mutual contact of the free longitudinal edges of the two doors. In this connection it is disadvantageous that the passage of the hopper discharge opening cannot be fully cleared; Besides the doors act as guide faces for the load to be discharged and can therefore become damaged by hard and sharp parts present in the load. This is particularly detrimental to the free longitudinal edges of the doors, which play an important part in sealing, as these edges are exposed to increased wear by the scouring load, which involves high maintenance cost.

SUMMARY OF THE INVENTION

An object of the invention is to provide a hopper construction which eliminates these drawbacks.

In accordance with the invention this is achieved with a hopper barge of the type described above in that the control mechanism can also impose a translatory movement on the hopper door between a lower stop position and a higher position, in which the hopper door is at least substantially positioned within the centre keelson box. As during opening the hopper door is withdrawn into the centre keelson box, the passage of the discharge opening is optimally cleared, resulting also in improved flushing after discharge, while scouring of the load along the door is reduced to the time required for swivelling and withdrawal. Owing to this withdrawal during opening it is furthermore effected that the hopper doors no longer extend below the bottom of the hopper during opening, while at the same time the advantage of spontaneous opening, which is not present in known, horizontally slidable hopper doors, which consequently do not extend below the bottom, is maintained.

A particularly advantageous embodiment of the invention, especially in the light of the occurring loads and the steps to be taken against undesired flexure is obtained with a hopper of the type described above with pairwise opposed hopper doors and a central control mechanism for mirror-symmetrically swivelling two opposed hopper doors, if the central control mechanism can cause two opposed hopper doors to also perform a mirror-symmetrical translatory movement.

In accordance with a preferred embodiment, the hopper according to the invention is constructed in such a manner that the hopper doors include pivots mounted on a carrier movable by the control mechanism. In this way the withdrawal of the hopper doors can be carried out easily.

In a variant of the hopper according to the invention each hopper door includes a number of journals which are slidable in guides and pivotable. Owing to such a guidance of four points of each hopper door the latter is saved from so-called "slamming". Moreover this construction is sturdy and hardly requires maintenance, while breakdowns, if any, of the doors can be remedied without the use of a dock.

If the control mechanism comprises at least one piston-cylinder assembly with a telescopic piston rod and at least one articulated rod connected to both the free end of the piston rod and to a hopper door, a particularly sturdy construction can be obtained by arranging the pivot between piston rod and articulated rod for sliding movement in a preferably vertical guide. This simple, but effective guidance prevents possible bending loads on the piston rod in case of asymmetrical load with pairwise opposed doors, while the advantages of such a guidance in a single door are even more evident.

In accordance with a further embodiment, the hopper according to the invention is so constructed that in the closed position the hopper doors form a hermetically closed space in upward direction with the box-shaped centre keelson, while means are present to pump air into said space. This renders it possible to build up advantageously a compressed-air cushion in and under the centre keelson box, the lower surface of which can be flush with the bottom of the hopper. By providing such a compressed-air cushion the resistance of the vessel is considerably reduced owing to the elimination of turbulences, while besides the floating power is increased. Moreover the control means can be pivoted to the lower edge of the hopper doors and be made of plate-like material, so that the hopper has a substantially flat bottom.

Another preferred embodiment resides in the divided construction of the centre keelson box comprising a fixed funnel-shaped part in the hopper and a top part removably mounted thereon, which in case of disassembly can remove the doors and control mechanism from the funnel-shaped part. This will reduce the cost for possible repair and for maintenance, while also the construction of the hopper is simplified, because the doors can be mounted as a prefab units in a late stage.

The invention will now be elucidated in more detail with reference to the drawings showing some embodiments by way of example.

DETAILED DESCRIPTION

Figure 1:
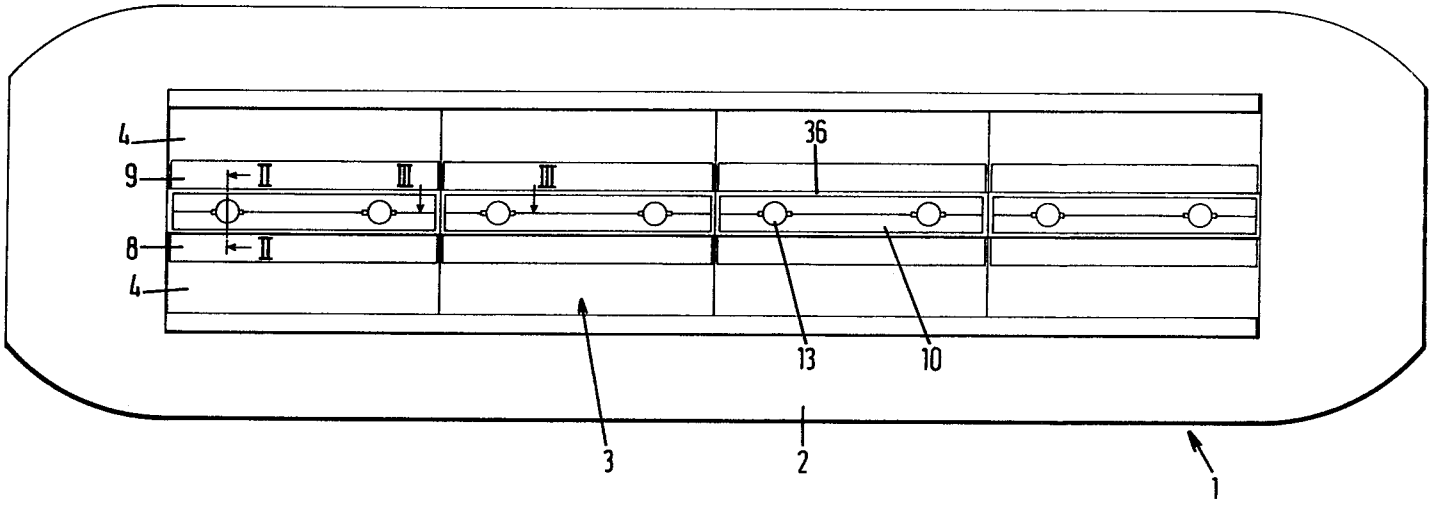
FIG. 1 is a plan view of the hopper barge with hopper doors according to the invention.

In the drawings, reference numeral 1 generally indicates the hopper barge having a deck 2 and a hopper 3 which is open at the top. Hopper 3 includes, seen in transverse direction, inclined and converging bottom parts 4. Furthermore, the hopper has a substantially horizontal bottom 5. To discharge the load, hopper 3 comprises throughout its length a discharge opening 6 arranged centrally in the hopper. Bottom parts 4 of hopper 3 and the bottom 5 of the hopper are connected by a vertical wall 7 adjacent to discharge opening 6. Discharge opening 6 can be closed by means of a pair of doors 8, 9. The hopper barge shown in FIG. 1 includes four pairs of doors 8, 9.

Each pair of doors 8, 9 is opened and closed by two control means accommodated in a box-shaped centre keelson 10 extending throughout the length of hopper 3. Each control means comprises a cylinder 11 and a piston with piston rod 12 mounted therein for controlled movement. Cylinder 11 is located for the greater part in a sleeve 13 which is hermetically closed at the top and is attached to and extends above centre keelson box 10. Cylinder 11 is pivoted on a pivot 14 in sleeve 13, the axis of which pivot is normal to that of sleeve 13. Sleeve 13 and piston rod 12 are so arranged that their axes lie both in the dividing plane of the discharge opening 6 and run vertically, which is also the case with the axis of cylinder 11 in its normal position. The dividing plane of centre keelson box 10 coincides with that of discharge opening 6.

Figure 3:
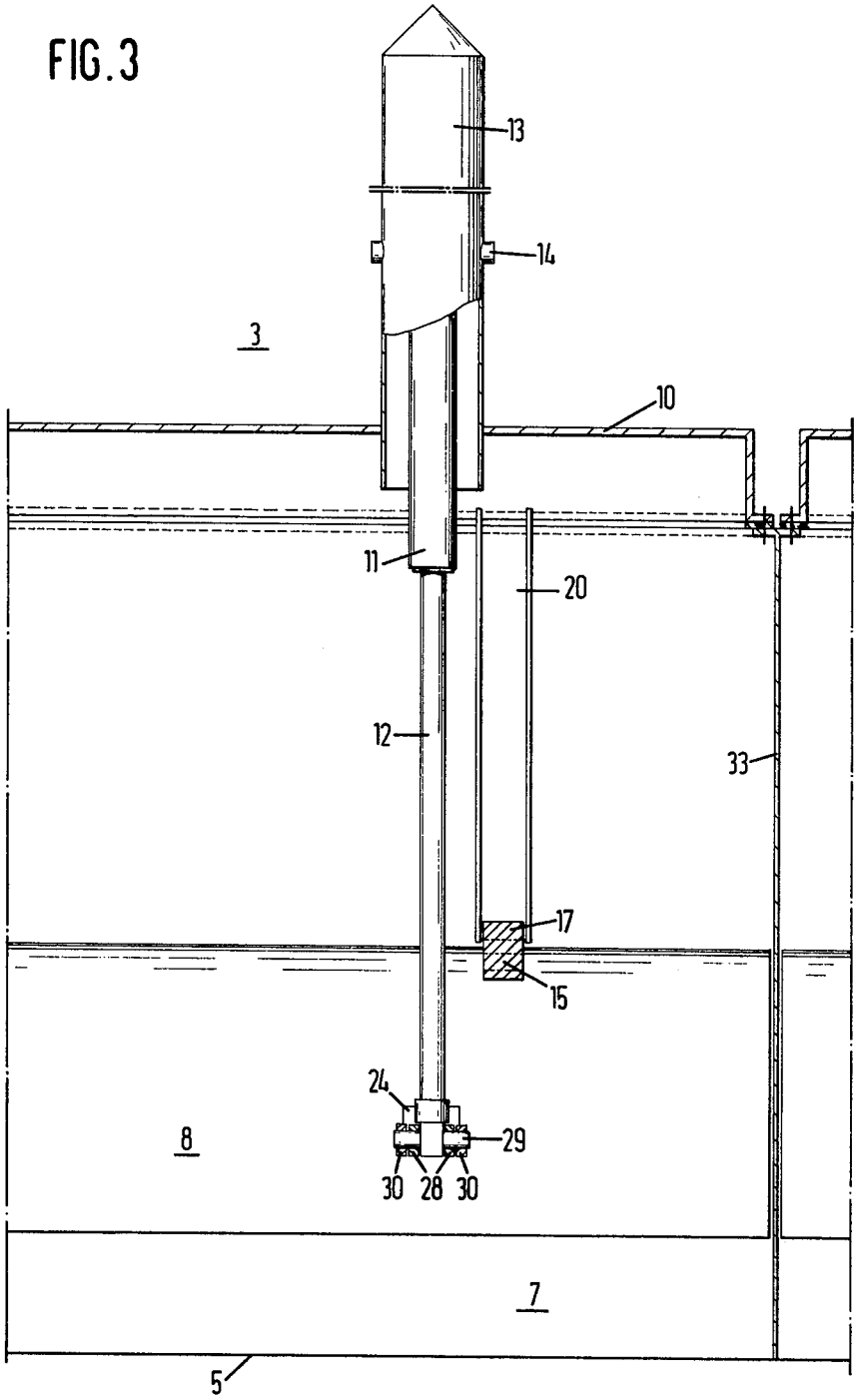
FIG. 3 is a longitudinal sectional view of the hopper doors with control device on the line III—III in FIG. 1.

By means of pivots 15 and 16 doors 8 and 9 are pivoted to a guide means 17 with two cams 18, 19 movable in vertical direction in two guideways 20, 21. The guideways are formed on the interior of the longitudinal sidewalls of the box-shaped centre keelson 10. The downward movement of guide means 17 is limited in that cams 18, 19 strike stops 22, 23 positioned along the lower edge of the centre keelson box 10 which is open there, the upward movement of guide means 17 is limited by the upper wall of centre keelson box 10. The bottom of doors 8, 9 includes two projections 24, 25, which serve as bearings for a pair of shafts 26, 27. A rod 28 is on one end pivoted to shaft 26 and on its other end to a shaft 29, which is bearing-mounted in the lower end of piston rod 12. On shaft 29 is furthermore bearing-mounted the end of a rod 30, the other end of which is pivoted to shaft 27. To obtain a favourable load of shaft 29 and its beaing at the lower end of piston rod 12, rods 28 and 30 have a double construction, as is shown in FIG. 3. Additionally, sealing means 31 are provided between doors 8, 9 and the lower edge of centre keelson box 10 and between doors 8, 9 and vertical walls 7 to obtain proper sealing of the hopper.

The operation of hopper doors 8, 9 is as follows. The starting position is the position in which doors 8, 9 of hopper 3 are closed, as is shown in the drawings, particularly in FIG. 2. If the load is to be discharged, the piston and piston rod 12 secured therein is moved upwardly in cylinder 11 by means (not shown). During the upward movement of shaft 29 bearing-mounted in the end of piston rod 12, the ends of rods 28 and 30 swivelling about shaft 29 will also be drawn upwards. As a result, doors 8 and 9 connected via shaft 29, rods 28 and 30, shafts 26 and 27 and projections 24 and 25, swivel towards one another. When the two doors are hanging vertically downwardly, i.e. both in the position of the door 9a shown by a chain line, which door cannot extend with its free end below bottom 5 owing to the preferred choice of the height of vertical wall 7, guide means 17 will be drawn upwardly upon further upward movement of shaft 29. When guide means 17 has reached its upper end position, doors 8 and 9 are almost fully drawn into centre keelson box 10 and discharge opening 6 can be used optimally, the additional advantages being that doors 8, 9 cannot be damaged and that better flushing is possible.

Hopper 3 is closed by the reverse movement of doors 8, 9 and the control means. The optimum closing position is reached with maximum swivelling of doors 8, 9 as in that case rods 28 and 30 are coaxial and shaft 29 is most favourably loaded.

After doors 8, 9 have closed, compressed air is pumped into the space which is then hermetically closed towards the top in and under centre keelson box 10 by means (not shown), till the lower surface of the compressed-air cushion thus formed forms a continuation of bottom 5 of hopper barge 1. As a consequence, considerably less resistance is experienced by the vessel, while an increase of floating power is obtained.

When doors 8, 9 are withdrawn in centre keelson box 10 the air filling of the centre keelson box can be maintained, so that the jack mechanism 11, 12 is always positioned in a dry space.

In the event of an obstacle being present in one of the two passages between centre keelson box 10 and bottom parts 4 when closing doors 8, 9, the other door can nevertheless be closed. This situation is illustrated by a chain line in FIG. 2. If door 9 is obstructed by an obstacle in the chain line position 9*a*, piston rod 12, upon further downward movement, will start pivoting about pivot 14 together with cylinder 11. In spite of the standstill of door 9, it is yet possible for door 8 to pivot about pivot 15 and the free longitudinal edge of door 8 can be closed against sealing means 31.

As shown in the drawings, centre keelson box 10 can include two parts, the lower part 32 of which, together with the adjacent bulkheads 33 form a unitary part of the vessel. The other part 34 is secured to part 32 with bolts 37 through flanges 35, 36, a packing 38 being interposed between flanges 35 and 36. When part 34 is removed in upward direction, the door and control mechanism is at the same time drawn out of part 32, so that owing to this division of the centre keelson box maintenance and repairs, if any, are facilitated. Additionally, the construction of the vessel has become more simple because the control mechanism and the doors can be manufactured while being separated from the hopper and can be mounted as prefab units in the substantially fully completed hopper barge.

Figure 4:
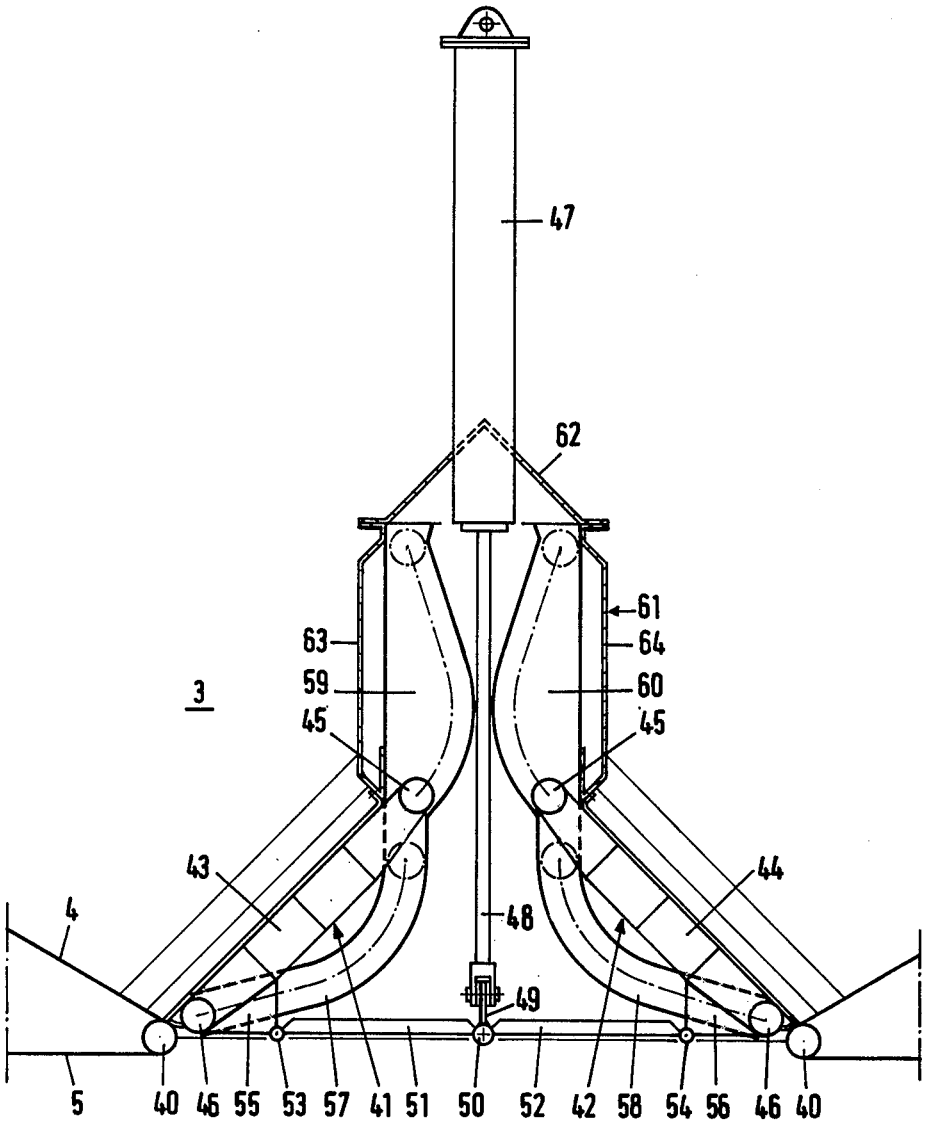
FIG. 4 is a variant of the hopper with hopper doors according to the invention, in which the doors are in the closed position.
Figure 5:
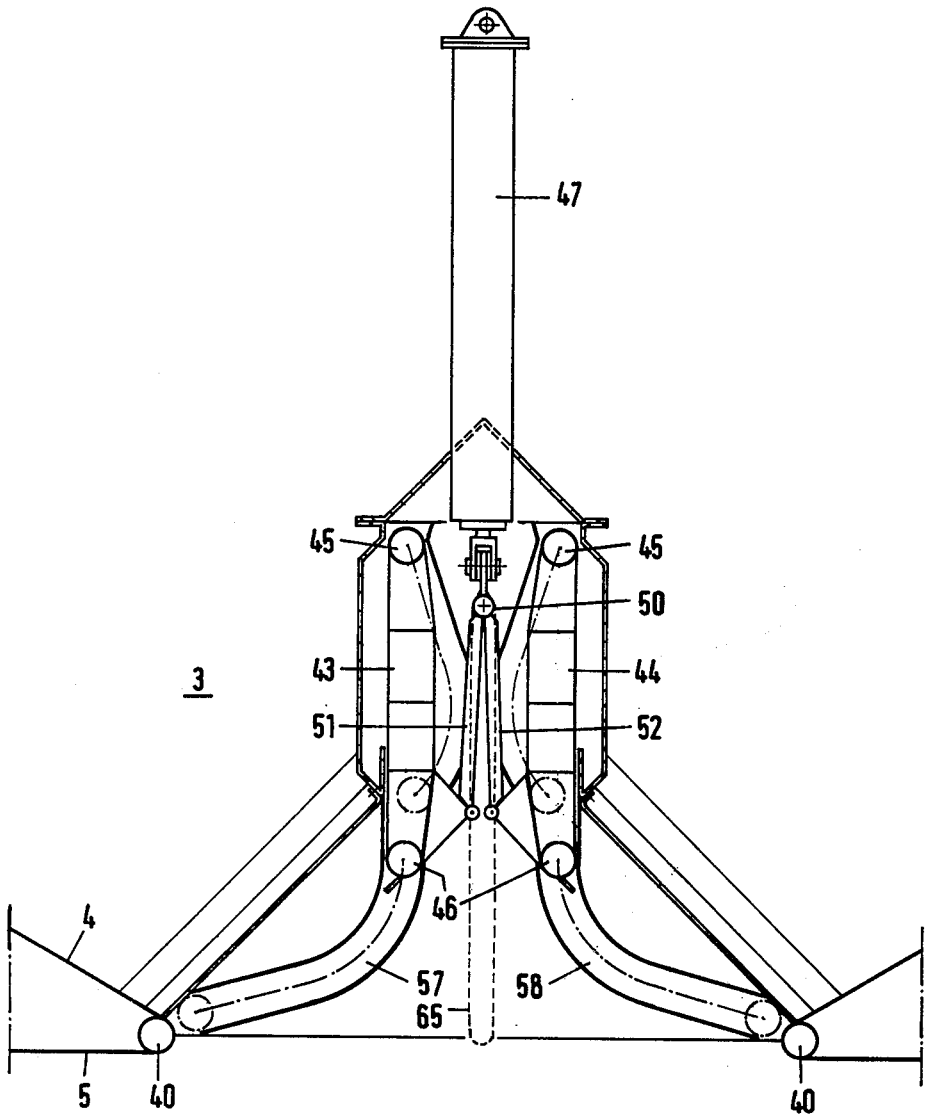
FIG. 5 shows the hopper of FIG. 4 with open hopper doors.

In the embodiment of the hopper with hopper doors shown in FIGS. 4 and 5 the hopper, the inclined bottom parts thereof and the substantially horizontal bottom and the discharge opening of the hopper are again indicated by reference numerals 3, 4, 5 and 6, respectively. The connection between inclined bottom parts 4 and bottom 5 of the hopper is effected by means of a pipe 40.

For closing discharge opening 6 use is made of a number of pairs of hopper doors 41, 42. These hopper doors are made of plate-like, rectangular bodies 43, 44, having a circular journal 45, 46 adjacent each corner.

One pair of doors 41, 42 is moved by means of a centrally arranged control mechanism comprising two hydraulic cylinders 47, each adapted to move a piston rod 48 in a controlled fashion. The free end of piston rod 48 is pivoted through a connecting piece 49 and a pivot 50 to the longitudinal edges of two plates 51, 52, the opposite longitudinal edges of which are pivoted through a pivot 53, 54 to two connecting members 55, 56, each secured to a door body 43, 44 along the lower edge thereof.

Journals 46 on door 41 are slidable and rotatable in a guideway 57, while journals 46 on door 42 are slidable and rotatable in a guideway 58, guideways 57 and 58 having a mirror-symmetrical construction with respect to the longitudinal median perpendicular plane of the hopper. The two journals 45 on door 41 are each slidable and rotatable in a guideway 59, while journals 45 on door 42 are each slidable and rotatable in a guideway 60. Also these guideways 59 and 60 have a mirror-symmetrical construction. Guideways 57, 58, 59 and 60 are attached to the front or rear end wall of hopper 3 or to a partition dividing hopper 3 into a number of compartments, each compartment being closable by a pair of hopper doors 41, 42.

Furthermore, along the edges of the discharge openings there are provided suitable sealing means adapted to cooperate with hopper doors 41, 42 when these doors are in the closed position to obtain proper sealing of hopper 3.

Guideways 59 and 60 are for the greater part positioned inside a centre keelson box 61 extending longitudinally of the hopper and being open at the bottom, said box including a cover 62 and two longitudinal walls 63, 64. The front and rear walls of centre keelson box 61 are formed by the front or rear end walls of hopper 3 or by a partition present therein. Cover 62 has at suitable places openings for passing the hydraulic cylinders 47. Again the construction is such that after removal of cover 62 the entire control mechanism together with doors 41, 42 can be removed in upward direction. Guideways 57–60 rigidly connected to the hopper remain in position, of course.

In order to move hopper doors 41, 42 from the closed position shown in FIG. 4 to the open position shown in FIG. 5 to discharge the load present in hopper 3 or in one compartment thereof, the two pistons of each pair of doors 41, 42 are actuated in such a manner that the two piston rods 48 are drawn upwardly simultaneously. Shaft 50 secured to piston rods 48 will then also be drawn upwardly and consequently plates 51 and 52 will be inclined to swivel downwardly and towards one another around shaft 50. Doors 41 and 42 connected along their lower edges to plates 51 and 52 through shafts 53 and 54 and connecting members 55 and 56 are drawn inwardly and upwardly owing to the displacement of plates 51 and 52, this movement being controlled by journals 45 and 46 sliding and rotating in guideways 57–60. The opening movement of the doors is further supported by the load slipping out of hopper 3 once the opening movement has set in. The path to be traversed by journals 45 and 46 during opening is shown by a chain line in FIGS. 4 and 5. Reference numerals 45' and 46' in FIG. 4 show the positions of the journals in the fully open position of doors 41 and 42, these doors being almost entirely positioned in centre keelson box 61 and extending vertically, as can be seen in FIG. 5.

Discharge opening 6 is closed by pushing shaft 50 downwardly by means of piston rods 48 out of the position shown in FIG. 5, as a result of which also doors 41 and 42 are drawn downwardly and outwardly again. After the closed position shown in FIG. 4 has been reached again, plates 51 and 52 extend substantially horizontally. This will not only load shaft 50 favourably, doors 41 and 42 being automatically locked, but imparts a substantially flat, continuous bottom to the hopper. In order to even further reduce turbulences and resistance during navigating and to increase the floating power it is possible to pump air into the space defined by plates 51 and 52, doors 41 and 42 and centre keelson box 61.

By guiding each door adjacent its four corners by means of four journals running in guideways, the doors are prevented from "slamming", while also forces exerted on the door during opening by the discharging load are taken up and transferred advantageously.

Guideways 57–60 for doors 41, 42 are constructed in such a manner that during movement of the doors they slide along and rotate about the lower edges of longitudinal walls 63, 64 of centre keelson box 61 and are always in sealing engagement with these edges. Besides this sealing effect the doors have a supporting function for longitudinal walls 63, 64.

Figure 2:
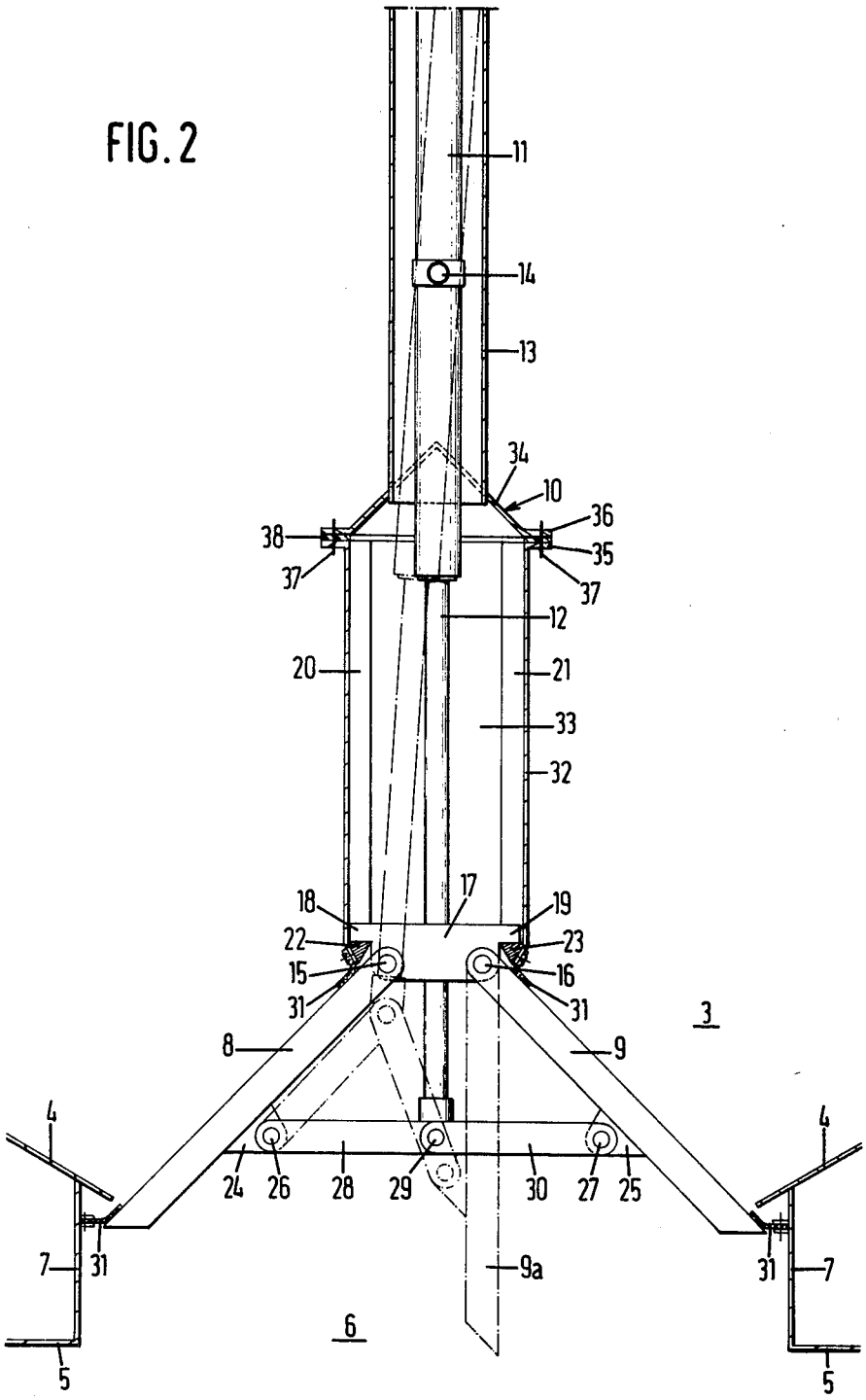
FIG. 2 is a cross-sectional view of the hopper doors with control device on the line II—II in FIG. 1.

Just as in the construction illustrated in FIGS. 2 and 3 the doors and the control mechanism can be mounted as prefab units in a late stage of the hopper construction. It is also possible, for example in case of repair, to remove this unit entirely, carry out repair work and mount the assembly again without the need of using a dock. All these advantages of the hopper with hopper doors according to the invention result in a considerable saving in time and cost.

It is possible to construct the centre keelson box with the doors in transverse direction and to arrange two or more centre keelson boxes with door and control mechanism in juxtaposed relationship, just as in the longitudinal construction.

It will be clear that the invention is not limited to the embodiments described above and shown in the drawings but that all kinds of variants and modifications are possible without departing from the scope of the present invention, such as arranging projections 24 and 25 adjacent the free end of the doors, bearing-mounting shaft 29 or 50 on both ends in the end of piston rods 29 or 48 and arranging more than two hydraulic cylinders for each door pair.

To ensure that piston rod 12 or 48 will in no case be subjected to a bending load, there may be a guide for shaft 29 or 50, as shown in FIG. 5 by a broken line and reference numeral 65.

Though the embodiments always show two hopper doors it is clear that the construction can also be realized with one hopper door arranged, for example, instead of centrally, on the sidewall of the hopper.

I claim:

1. A hopper barge comprising a hopper including opposed inclined converging bottom walls and vertical walls extending downwardly from said bottom walls to define an outlet, a center keelson box positioned above said outlet at a level above the bottom walls, a pair of pivotable doors for closing said outlet, and control means coupled to said doors to pivotably and translationally move the same from a first position in which the doors close said outlet to a second position in which the doors are suspended vertically and are substantially withdrawn into the keelson box to open said outlet, said doors in said first position extending obliquely and having respective free ends in sealed relation with said walls of the hopper, said control means including means engaging said doors at an intermediate location along the length thereof for moving the doors pivotably and translationally between said first position in which the doors are oblique and are outside the keelson box and said second position in which said doors are suspended vertically within the keelson box.

2. A hopper barge according to claim 1 wherein: each hopper door comprises a number of journals, which journals are slidable and pivotable in guides.

3. A hopper barge according to claim 1 wherein: the hopper doors include pivots mounted on a carrier movable by the control means.

4. A hopper barge according to claim 1, wherein the control means comprises at least one piston-cylinder assembly with a telescopic piston rod and an articulated rod connected both to the free end of the piston and to a respective hopper door, and the pivot between the piston rod and the articulated rod being slidable in a vertical guide.

5. A hopper barge according to claim 1 wherein: the centre keelson box includes a sleeve-like part secured to the hopper and an upper part mounted for removal, said door and control means being removable from the sleeve-like part in case of disassembly through said hopper.

6. A hopper barge according to claim 1 wherein: said centre keelson is box-shaped and forms a hermetically closed bell-shaped space in upward direction, means being present to pump air into said space.

7. A hopper barge according to claim 1 wherein said means for moving the doors is centrally and symmetrically arranged relative to said doors to move said doors symmetrically between said first and second positions.

* * * * *